US008910609B2

(12) United States Patent
Rothkegel

(10) Patent No.: US 8,910,609 B2
(45) Date of Patent: Dec. 16, 2014

(54) PISTON FOR AN INTERNAL COMBUSTION ENGINE

(71) Applicant: BRP-Powertrain GmbH & Co. KG, Gunskirchen (AT)

(72) Inventor: Thomas Rothkegel, Steinhaus (AT)

(73) Assignee: BRP-Powertrain GmbH & Co. KG, Gunskirchen (AT)

( * ) Notice: Subject to any disclaimer, the term of this patent is extended or adjusted under 35 U.S.C. 154(b) by 0 days.

(21) Appl. No.: 13/750,160

(22) Filed: Jan. 25, 2013

(65) Prior Publication Data

US 2013/0192556 A1 Aug. 1, 2013

Related U.S. Application Data

(60) Provisional application No. 61/591,427, filed on Jan. 27, 2012.

(51) Int. Cl.
*F02F 3/00* (2006.01)
*F02F 3/24* (2006.01)

(52) U.S. Cl.
CPC ..... *F02F 3/0076* (2013.01); *F02F 2003/0007* (2013.01); *F02F 3/24* (2013.01)
USPC ..... 123/193.6; 92/239

(58) Field of Classification Search
CPC ..... F02F 3/0069; F02F 3/0076; F02F 3/24; F02F 2003/0007
USPC ..... 123/193.6; 92/239, 238, 208, 209; 29/888.04, 888.05
See application file for complete search history.

(56) References Cited

U.S. PATENT DOCUMENTS

| | | | | | |
|---|---|---|---|---|---|
| 1,526,491 | A | * | 2/1925 | Cox | 92/237 |
| 2,100,719 | A | * | 11/1937 | Nelson | 92/233 |
| 2,217,542 | A | * | 10/1940 | Flammang et al. | 92/233 |
| 4,702,151 | A | * | 10/1987 | Munro et al. | 92/237 |
| 5,020,485 | A | * | 6/1991 | Watanabe | 123/73 C |
| 5,063,893 | A | | 11/1991 | Iwaya | |
| 5,150,517 | A | | 9/1992 | Leites et al. | |
| 2010/0147250 | A1 | | 6/2010 | Boczek et al. | |

FOREIGN PATENT DOCUMENTS

| | | | |
|---|---|---|---|
| AT | 505592 | A1 | 2/2009 |
| BE | 450700 | A | 6/1943 |
| DE | 4016507 | A1 | 11/1990 |
| EP | 2295777 | A1 | 3/2011 |
| GB | 417007 | A | 9/1934 |
| JP | 2005002861 | A | 1/2005 |

OTHER PUBLICATIONS

European Search Report of European Application No. 13152720.2, Munich Jun. 21, 2013; Dragos Luta.
English Abstract of AT505592, Published Feb. 15, 2009; Retrieved from the Internet: http://worldwide.espacenet.com on Aug. 15, 2013.
English abstract of JP2005-002861; retrieved from Japanese Patent Office on Jan. 3, 2012.

* cited by examiner

*Primary Examiner* — Hung Q Nguyen
(74) *Attorney, Agent, or Firm* — BCF LLP

(57) ABSTRACT

A piston for an internal combustion engine has a crown, a skirt extending from the crown, a pair of pin bosses, and a plurality of struts connecting the pin bosses to inner sides of the crown and skirt. An internal combustion engine having the piston is also disclosed.

18 Claims, 10 Drawing Sheets

PISTON FOR AN INTERNAL COMBUSTION ENGINE

CROSS-REFERENCE

The present application claims priority to U.S. Provisional Patent Application No. 61/591,427, filed Jan. 27, 2012, the entirety of which is incorporated herein by reference.

FIELD OF THE INVENTION

The present invention relates to pistons for internal combustion engines.

BACKGROUND

In order to make engine powered vehicles more energy efficient, in addition to implementing various technologies that improve the energy consumption of the engine itself, vehicle and engine manufacturers also try to reduce the weight of the various components of the vehicle, including the engine.

Pistons are one of the most important components of reciprocating internal combustion engine. The pistons transfer the energy of the expanding combustion gases in the combustion chamber to the crankshaft of the engine, thereby causing the crankshaft to turn. However, the pistons also represent a significant amount of the reciprocating masses of the engine.

For this reason, in many engines, the steel from which the pistons were traditionally made has been replaced with aluminum. In addition to being lighter in weight, aluminum pistons are also less expensive and provide good heat conductivity characteristics.

One of the disadvantages of aluminum pistons is that they are less resistant to high temperatures than steel pistons. The overheating of a piston can lead to deformation and cracking of the crown of the piston and to ductile deformation of the pin bosses used to attach the piston to the connecting rod.

High temperatures of the pistons can be the result of many different factors. For example, high power output engines tend to be hotter. In order to achieve low emissions and low fuel consumptions, many engine manufacturers opt for a lean air-fuel mixture to be combusted in the combustion chambers, which results in higher temperature combustion engines. In carbureted two-stroke engines, a fuel mixed with air flows in the crankcase that can absorb some of the heat from the pistons. However, some two-stroke engines now employ direct fuel injection technology where the fuel is injected directly in the combustion chambers. As a result, there is no more fuel flowing in the crankcase that could absorb heat from the pistons, and therefore the pistons get hotter. As such, aluminum pistons may not be suitable in engines having one or more of the above-described characteristics.

Therefore, there is a need for a relatively lightweight piston having good heat resistance characteristics.

SUMMARY

It is an object of the present invention to ameliorate at least some of the inconveniences present in the prior art.

In one aspect, the present invention provides a piston for an internal combustion engine having a crown having a crown outer side and a crown inner side and a skirt extending from the crown. The skirt has a skirt outer side and a skirt inner side. The skirt defines a reciprocation axis of the piston. First and second pin boss assemblies are connected to the crown inner side and the skirt inner side. The first and second pin boss assemblies define a pin bore axis perpendicular to the reciprocation axis. The first and second pin boss assemblies are adapted for receiving a piston pin having a piston pin axis with the piston pin axis being coaxial with the pin bore axis. The first and second piston boss assemblies are disposed on opposite sides of the reciprocation axis and are spaced apart in a direction defined by the pin bore axis. Each of the first and second pin boss assemblies has a pin boss, a rib, a central strut, and first and second diagonally extending struts. The pin boss defines a pin bore. The pin bore defines the pin bore axis. The rib extends from the crown inner side toward the pin boss. The rib is generally aligned with the pin boss in the direction defined by the pin bore axis. The rib extends along the crown inner side along a direction generally parallel to a lateral axis of the piston. The lateral axis of the piston intersects and is perpendicular to the reciprocation axis and the pin bore axis. The central strut extends from the pin boss to the crown inner side in a direction generally parallel to the reciprocation axis. The central strut is generally centered relative to the pin bore axis. The first diagonally extending strut has a first end connected to the pin boss and a second end connected to a junction of the crown inner side and the skirt inner side. The second diagonally extending strut has a first end connected to the pin boss and a second end connected to the junction of the crown inner side and the skirt inner side. The first and second struts are disposed on opposite sides of a plane containing the reciprocation axis and the pin bore axis.

In a further aspect, for each of the first and second pin boss assemblies, the central strut is connected to the rib.

In an additional aspect, for each of the first and second pin boss assemblies a dimension of at least a portion of the central strut in a direction defined by the lateral axis is less than 40 percent of a diameter of the pin bore.

In a further aspect, for each of the first and second pin boss assemblies: a dimension of a portion of the first strut in the direction defined by the pin bore axis is at least twice a dimension of the portion of the first strut in a direction perpendicular to the pin bore axis and to a central longitudinal axis of the first strut; and a dimension of a portion of the second strut in the direction defined by the pin bore axis is at least twice a dimension of the portion of the second strut in a direction perpendicular to the pin bore axis and to a central longitudinal axis of the second strut, In an additional aspect, for each of the first and second pin boss assemblies a dimension of the second strut in the direction defined by the pin bore axis is at least 20 percent greater at the second end of the second strut than at the first end of the second strut.

In a further aspect, each of the first and second pin boss assemblies also has: a third diagonally extending strut having a first end connected to the pin boss and a second end connected to the skirt inner side, the second end of the third strut being further from the crown than the first end of the third strut, the third strut being disposed on a same side of the plane as the first strut; and a fourth diagonally extending strut having a first end connected to the pin boss and a second end connected to the skirt inner side, the second end of the fourth strut being further from the crown than the first end of the fourth strut, the fourth strut being disposed on a same side of the plane as the second strut.

In an additional aspect, for each of the first and second pin boss assemblies: a dimension of a portion of the third strut in the direction defined by the pin bore axis is between 50 and 70 percent of a dimension of a portion of the first strut in the direction defined by the pin bore axis; and a dimension of a portion of the fourth strut in the direction defined by the pin bore axis is between 50 and 70 percent of a dimension of a portion of the second strut in the direction defined by the pin bore axis.

In a further aspect, for each of the first and second pin boss assemblies: the plane is a first plane; the second end of the third strut is further from a second plane than the first end of the third strut; the second plane contains the reciprocation axis and the lateral axis; and the second end of the fourth strut is further from the second plane than the first end of the fourth strut.

In an additional aspect, a ring is connected to the skirt inner side. For each of the first and second pin boss assemblies: the pin boss is disposed between the ring and the crown in a direction defined by the reciprocation axis; and the second ends of the third and fourth struts are connected to the ring.

In a further aspect, a ring is connected to the skirt inner side. For each of the first and second pin boss assemblies: the pin boss is disposed between the ring and the crown in a direction defined by the reciprocation axis.

In an additional aspect, the plane is a first plane. A second plane contains the reciprocation axis and the lateral axis. The skirt defines a first arch and a second arch at a free end thereof. The first and second arches are disposed on opposite sides of the second plane.

In a further aspect, the crown defines a piston ring groove on an outer circumference thereof.

In an additional aspect, the plane is a first plane. A second plane contains the reciprocation axis and the lateral axis. The piston is asymmetrical about the first plane. The piston is symmetrical about the second plane.

In a further aspect, the crown, the skirt and the first and second pin boss assemblies are made of steel.

In an additional aspect, the crown, the skirt and the first and second pin boss assemblies are integrally formed via a casting process.

In another aspect, the present invention provides an internal combustion engine having a cylinder, a piston according to one or more of the above aspects disposed in the cylinder, a piston pin received in the piston bores of the piston, a connecting rod having a first end connected to the piston pin and a second end, and a crankshaft connected to the second end of the connecting rod.

In a further aspect, the engine is a direct fuel injection two-stroke engine.

Embodiments of the present invention each have at least one of the above-mentioned object and/or aspects, but do not necessarily have all of them. It should be understood that some aspects of the present invention that have resulted from attempting to attain the above-mentioned object may not satisfy this object and/or may satisfy other objects not specifically recited herein.

Additional and/or alternative features, aspects, and advantages of embodiments of the present invention will become apparent from the following description, the accompanying drawings, and the appended claims.

BRIEF DESCRIPTION OF THE DRAWINGS

For a better understanding of the present invention, as well as other aspects and further features thereof, reference is made to the following description which is to be used in conjunction with the accompanying drawings, where.

DETAILED DESCRIPTION

A direct injection, two-stroke engine 10 having a high pressure fuel pump 12 will be described. However, it is contemplated that the embodiments of pistons described below could also be used in other types of engines, such as, but not limited to, carbureted or semi-direct injection engines and/or engines using low pressure fuel pumps.

Figure 1:
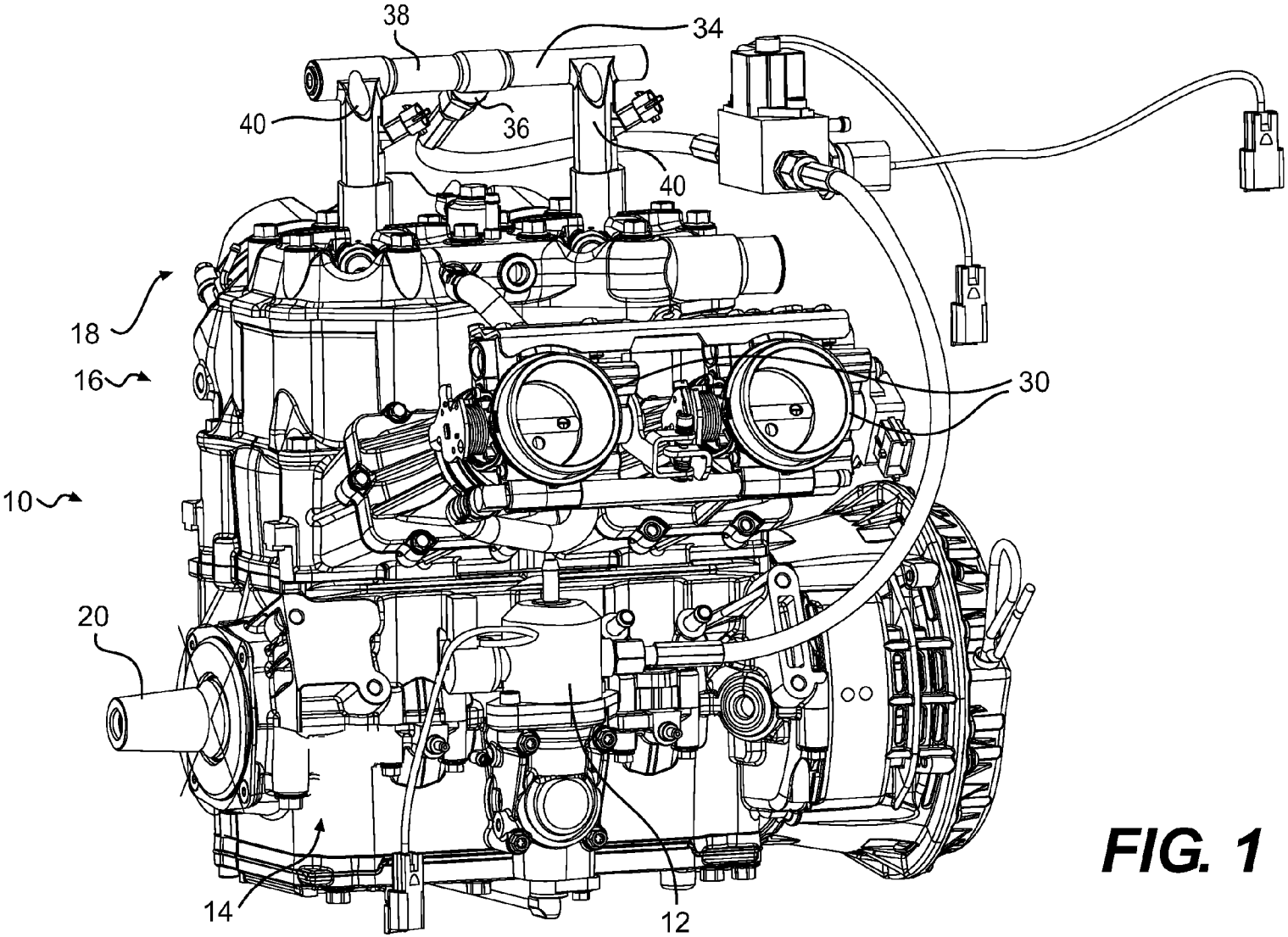
FIG. 1 is a perspective view taken from a first end of an intake side of a two-stroke internal combustion engine.
Figure 2:
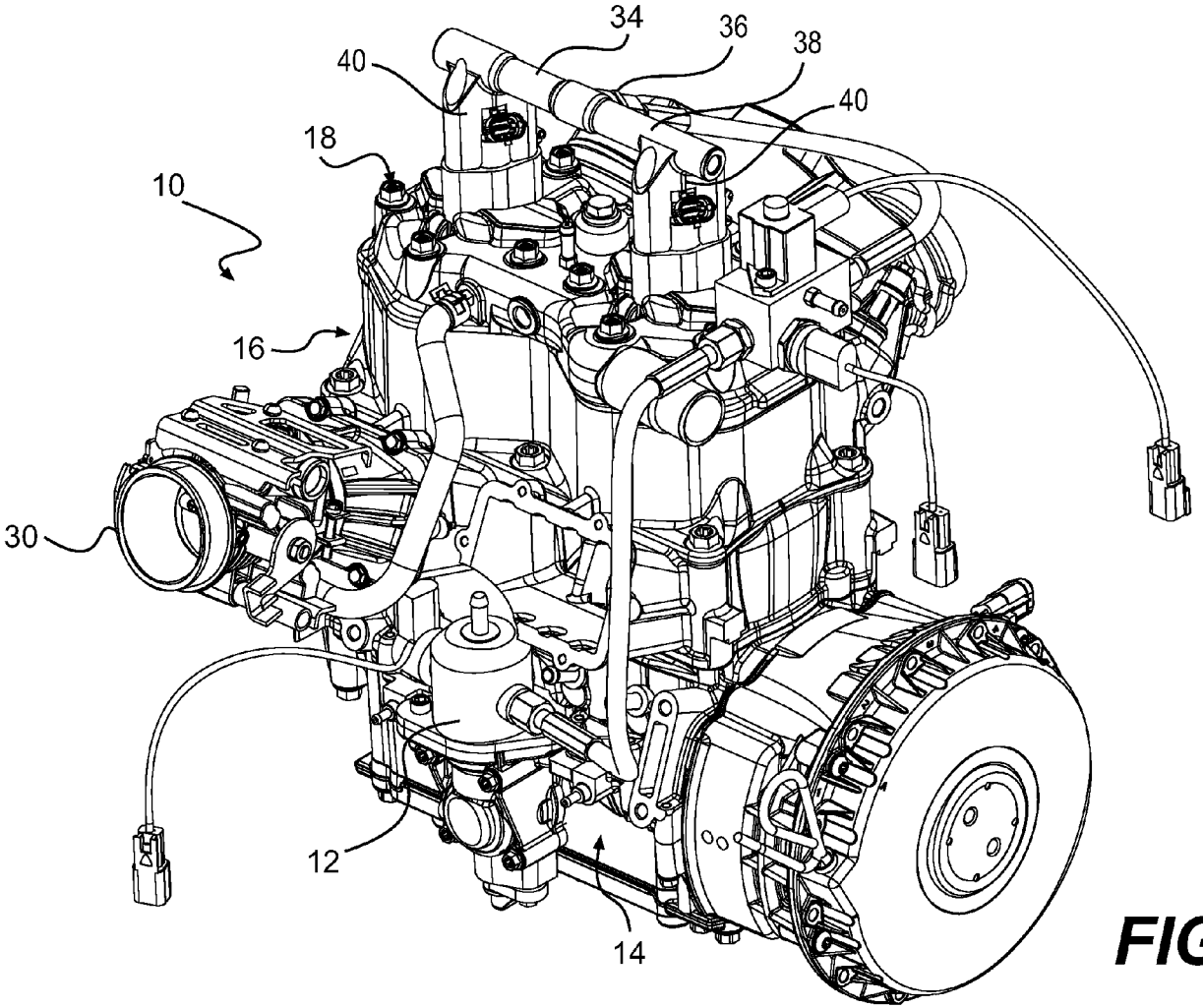
FIG. 2 is a perspective view taken from a second end of an intake side of the engine of FIG. 1, with one throttle body removed.
Figure 3:
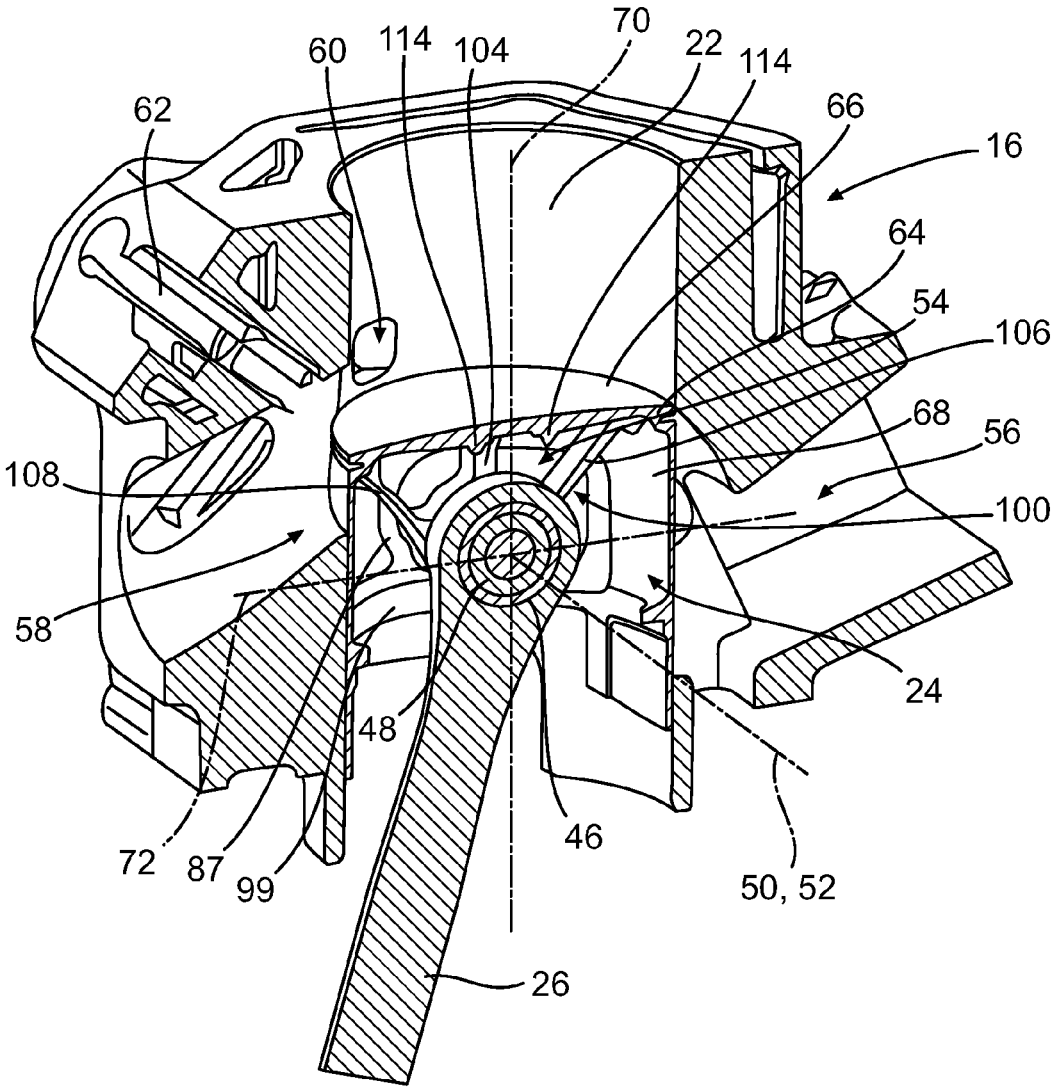
FIG. 3 is a cross-sectional view of a portion of a cylinder block of the engine of FIG. 1 taken through a center of a cylinder thereof with a piston disposed therein.

As seen in FIGS. 1 and 2, the engine 10 has a crankcase 14, a cylinder block 16, and a cylinder head 18. A crankshaft 20 is disposed inside the crankcase 14 to rotate therein and extends through a wall of the crankcase 14 to be operatively connected to an element to be driven by the engine 10, such as a wheel of a motorcycle or an endless track of a snowmobile. The cylinder block 16 defines two cylinders 22 in line (one of which is shown in FIG. 3) therein. Two pistons 24 (one of which is shown in FIG. 3) are disposed inside the cylinders 22 to reciprocate therein. The pistons 24 are connected to the crankshaft 20 via connecting rods 26 (one of which is shown in FIG. 3) to drive the crankshaft 20. It is contemplated that the engine 10 could have one or more than two cylinders 22 with a corresponding number of pistons 24 and connecting rods 26. It is also contemplated that the cylinders 24 could have a configuration other than inline. For example, the cylinders 24 could be arranged to form a V, in which case the engine 10 would be a V-type engine. The cylinder head 18, the cylinders 22, and the pistons 24 define two combustion chambers (not shown). Two throttle bodies 30 are connected to one side of the cylinder block 16 to supply air to the cylinders 22. This side of the engine 10 will be referred to herein as the intake side of the engine 10. An exhaust manifold (not shown) is connected to another side of the cylinder block 16 to receive exhaust gases from the cylinders 22 resulting from the combustion process occurring in the combustion chambers. This side of the engine 10 will be referred to herein as the exhaust side of the engine 10. Two fuel injectors (not shown) are connected to the cylinder head 18 to supply fuel to the combustion chambers. A fuel rail 34 is connected to the cylinder head 18 to supply fuel to the fuel injectors. The fuel rail 34 has a single inlet 36 connected to a center of a tube 38 and two outlets 40 connected near the ends of the tube 38. The outlets 40 are disposed at an angle to the inlet 36. The inlet 36 fluidly communicates with the fuel pump 12 and the outlets 40 fluidly communicate with the fuel injectors. The engine 10 also has other components known to those skilled in the art, such as spark plugs, but since these are not believed to be necessary to the understanding of the present, they will not be described herein.

Figure 4:
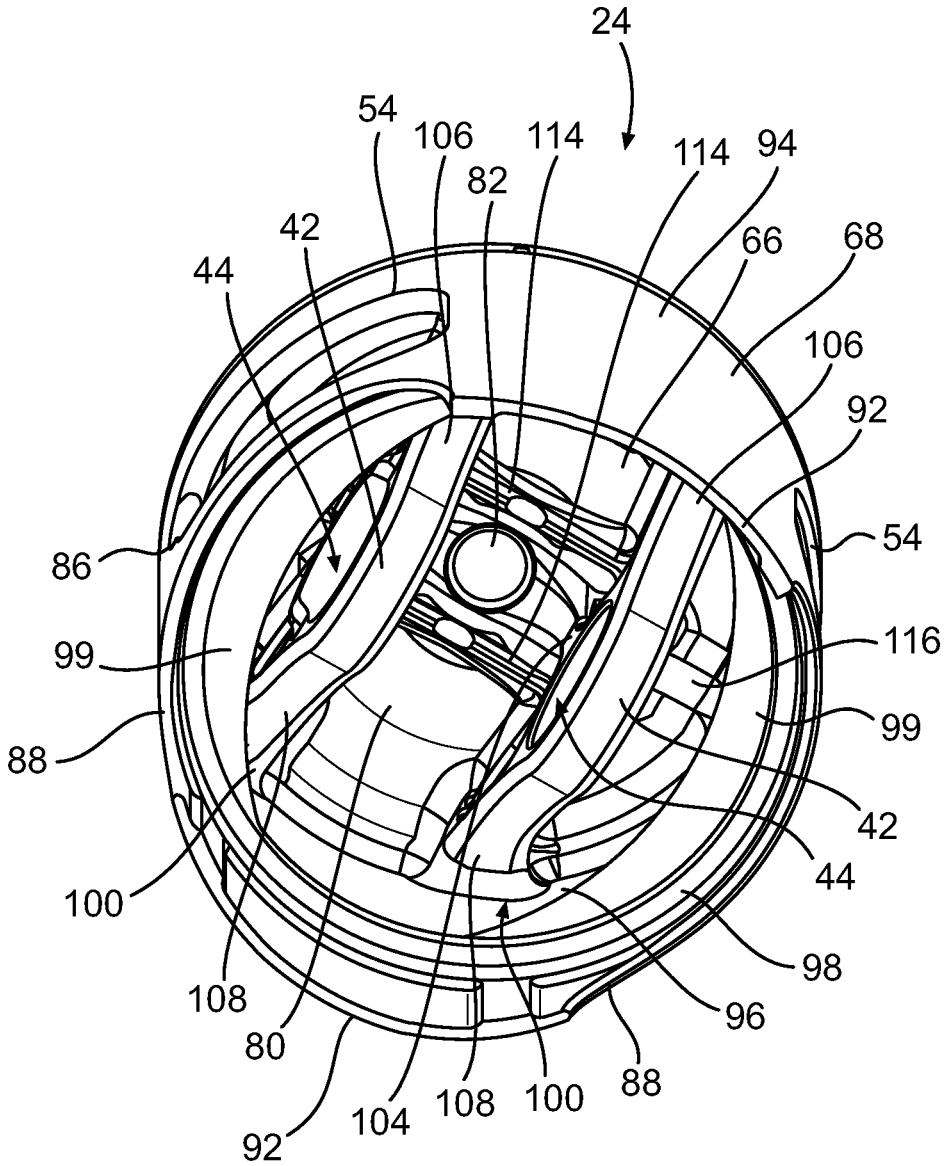
FIG. 4 is a perspective view of the piston of FIG. 3 taken from a bottom thereof.

Turning now to FIG. 3, the connection of one of the pistons 24 to the crankshaft 20 will be described in more detail. The other one of the pistons 24 is connected to the crankshaft 20 in the same manner. The piston 24 has a pair of pin bosses 42 defining a pair of pin bores 44 (see FIG. 4 for example). The connecting rod 26 has one end received between the pin bosses 42. This end of the connecting rod 26 defines a bore 46 arranged coaxially with the pin bores 44. The other end of the connecting rod 26 is connected to the crankshaft 20. A piston pin 48 is inserted in the pin bores 44 and the bore 46. A piston pin axis 50 of the piston pin 48 is coaxial with a pin bore axis 52 of the pin bores 44. Windows 54 defined in the piston 24 permit the insertion and removal of the piston pin 48 from the pin bores 44 and the bore 46. The windows 54 will be described in greater detail below.

As the piston 24 reciprocates in the cylinder 22, it opens and closes an intake port 56, an exhaust port 58, and a pair of auxiliary exhaust ports 60 (only one of which is shown) as is typical of two-stroke engines. It is contemplated that the auxiliary exhaust ports 60 could be omitted. The intake port 56, the exhaust port 58 and the auxiliary exhaust ports 60 are formed by the cylinder block 16. The cylinder block 16 also defines a passage 62 to receive an exhaust valve assembly (not shown) used to change the surface areas of the exhaust port 60 and of the auxiliary exhaust ports 62 depending on the operating conditions of the engine 10. It is contemplated that the exhaust valve assembly, and therefore its associated passage 62 could be omitted. A piston ring 64 arranged around the piston 24, as will be described in greater detail below, helps prevent gases present in the combustion chamber from entering the chamber defined by the crankcase 14.

Turning now to FIGS. 4 to 11, one of the pistons 24 will be described in more detail. The other one of the pistons 24 is the same and will therefore not be described herein.

The piston 24 has a crown 66 and a generally cylindrical skirt 68 extending therefrom. A central axis of the skirt 68 defines a reciprocation axis 70 of the piston 24. As the name suggests, the reciprocation axis 70 is the axis along which the piston 24 reciprocates in the cylinder 22 and is coaxial with a central axis of the cylinder 22 (not shown). The reciprocation axis 70 intersects and is perpendicular to the pin bore axis 52. For purposes of the present application, the axis of the piston 24 that intersects and is perpendicular to both the pin bore axis 52 and the reciprocation axis 70 will be referred to herein as the lateral axis 72. It should be understood that the lateral axis 72 is used herein to indicate that the axis 72 extends laterally relative to the pin bore axis 52 which is considered to be the longitudinal axis of the piston 24. It should be understood that the terms lateral and longitudinal with respect to the axes 52 and 72 are use relative to the piston 24 and are not indicative of the position of these axes 52 and 72 relative to an engine having the pistons 24 and/or to a vehicle having an engine having the pistons 24, although they may correspond under some circumstances. A plane containing the reciprocation axis 70 and the pin bore axis 52 will be referred to herein as the longitudinal plane 74 of the piston 24. A plane containing the reciprocation axis 70 and the lateral axis 72 will be referred to herein as the lateral plane 76 of the piston 24. The portion of the piston 24 disposed between the longitudinal plane 74 and the intake port 56 will be referred to herein as the intake side of the piston 24 (i.e. the portion of the piston 24 to the right of axis 70 and plane 74 in FIGS. 8 and 11). The portion of the piston 24 disposed between the plane 74 and the exhaust port 58 will be referred to herein as the exhaust side of the piston 24 (i.e. the portion of the piston 24 to the left of axis 70 and plane 74 in FIGS. 8 and 11). As will become apparent from the description of the piston 24 below, the piston 24 is symmetrical about the lateral plane 76 and asymmetrical about the longitudinal plane 74.

Figure 8:
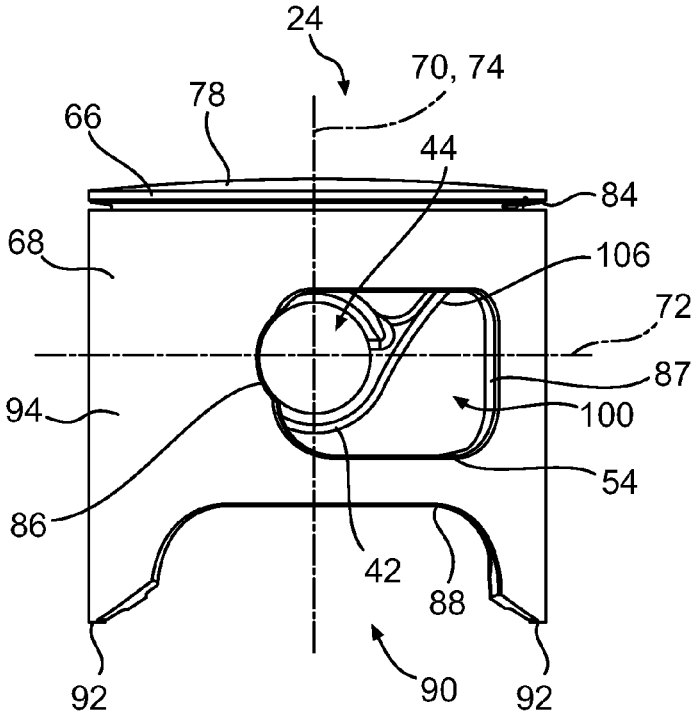
FIG. 8 is side elevation view of the piston of FIG. 3, the view of FIG. 8 being perpendicular to the view of FIG. 7.
Figure 9:
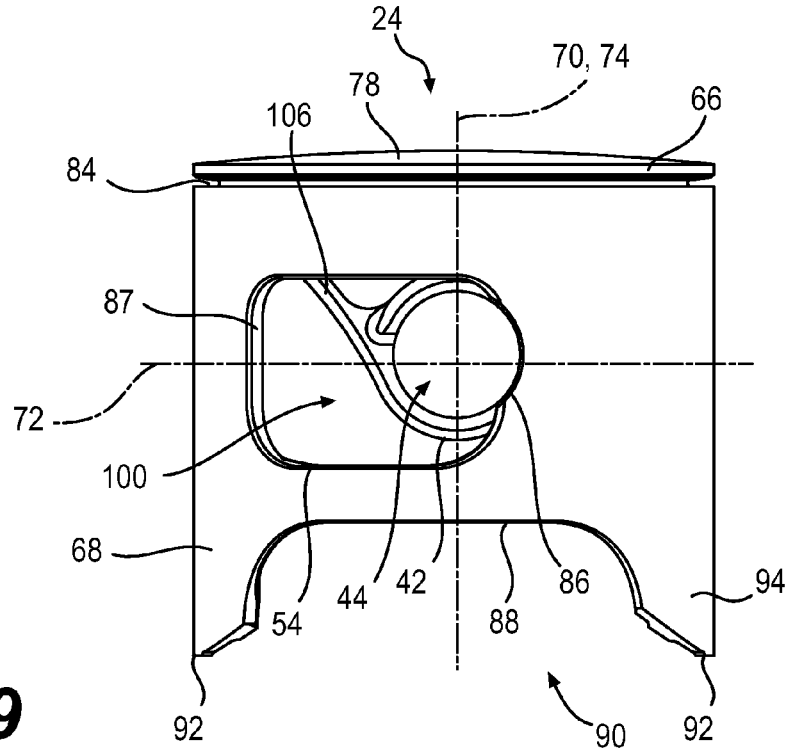
FIG. 9 is a side elevation view of the piston of FIG. 3 opposite the view shown in FIG. 8.
Figure 10:
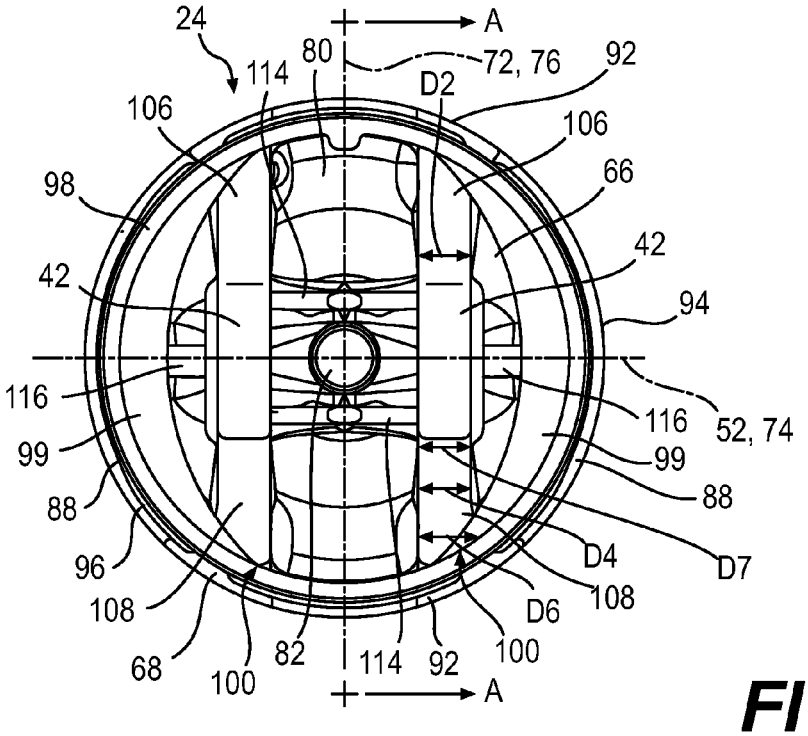
FIG. 10 is a bottom plan view of the piston of FIG. 3.
Figure 11:
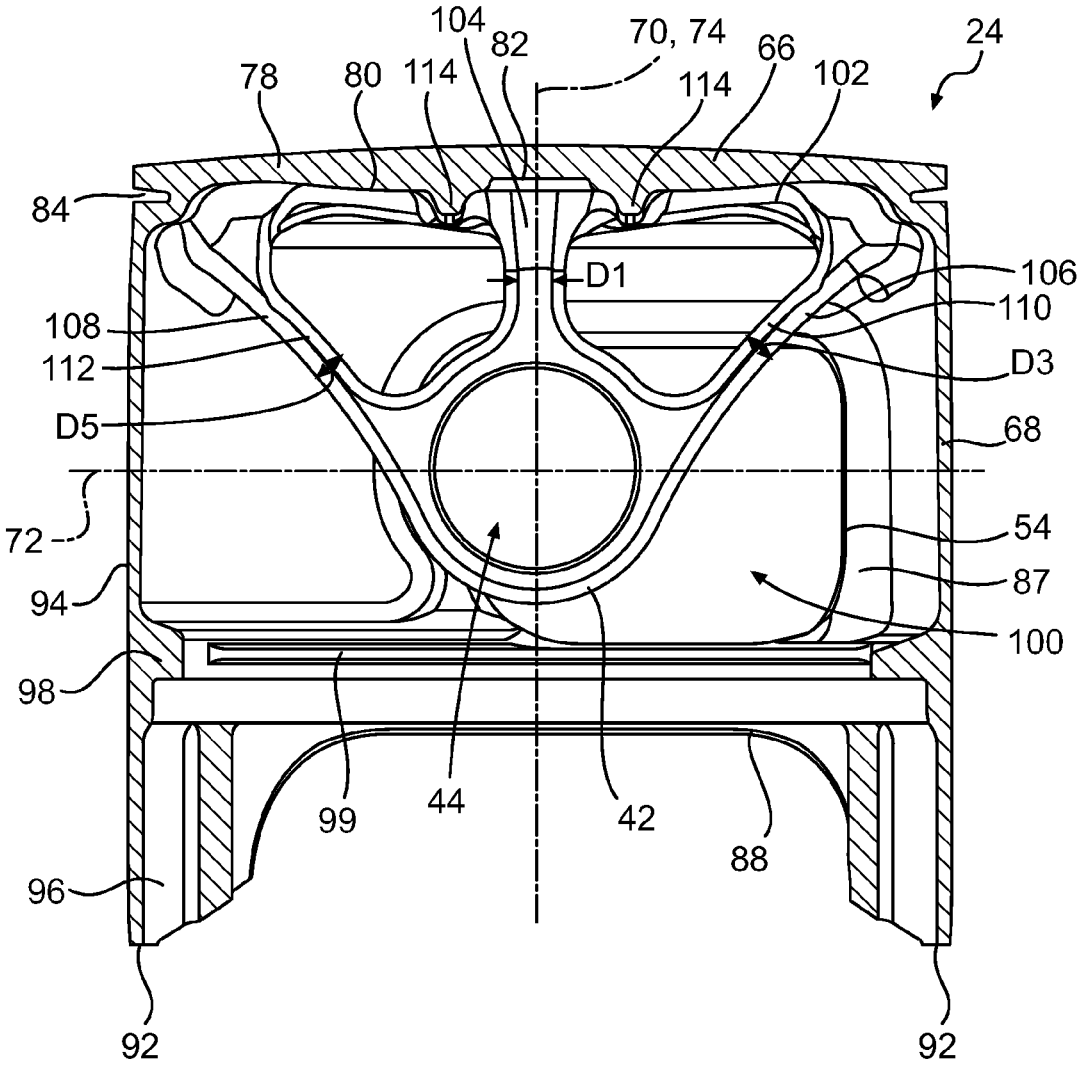
FIG. 11 is a cross-sectional view of the piston of FIG. 3 taken along line A-A of FIG. 10.

The crown 66 has a crown outer side 78 and a crown inner side 80. As can be seen in FIGS. 5, 7 to 9 and 11, the crown outer side 78 is a convex conical surface. It is contemplated that the crown outer side 78 could have other shapes, such as, for example, flat, concave, and hemispherical, and could be provided with one or more protrusions and/or recesses. The crown inner side 80 is slightly convex and has a circular recess 82 at a center thereof, as best shown in FIGS. 10 and 11. The crown 66 defines a ring groove 84 on an outer circumference thereof to receive the piston ring 64 therein.

Figure 5:
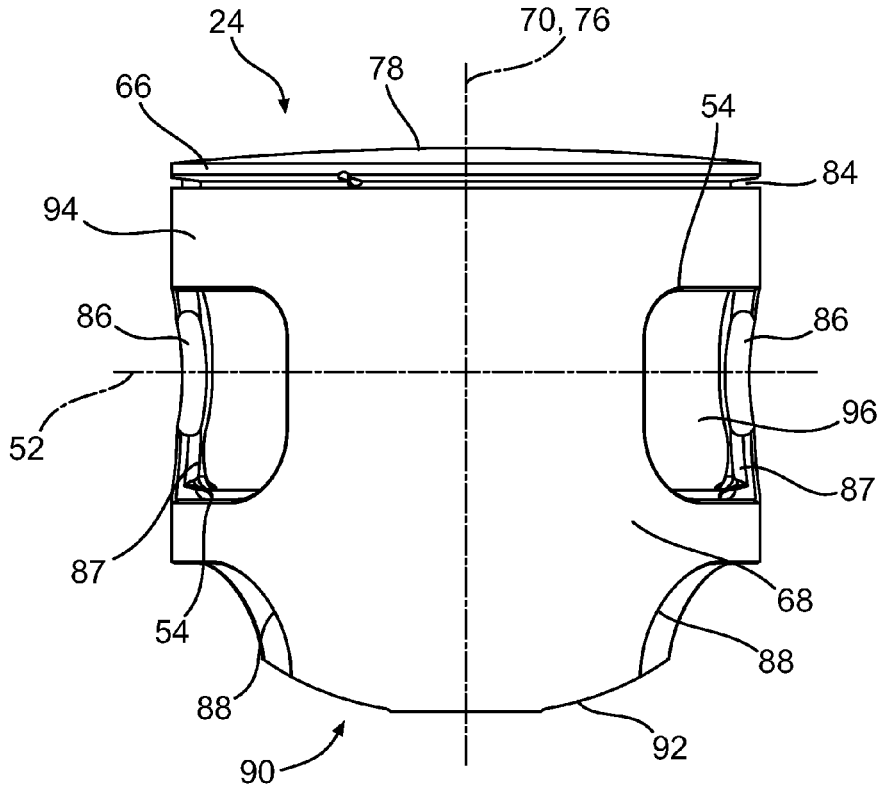
FIG. 5 is a side elevation view of the piston of FIG. 3 taken from an intake side thereof.
Figure 6:
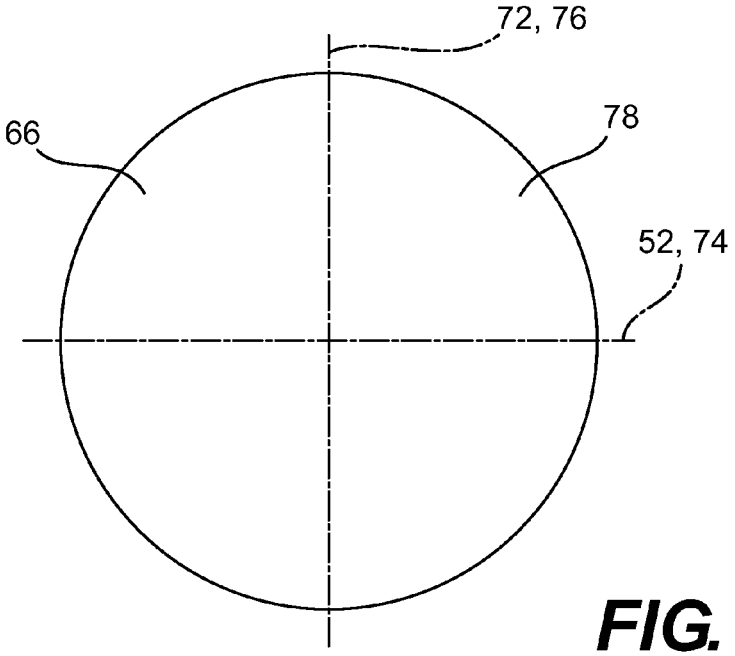
FIG. 6 is a top plan view of the piston of FIG. 3.

The skirt 68 defines the above-mentioned windows 54. As can be seen in FIG. 5, the two windows 54 are disposed opposite sides of the lateral plane 76 and are arranged symmetrically with respect to the lateral plane 76. As can be seen in FIGS. 8 and 9, a majority of the windows 54 is located on the intake side of the piston 24. It is contemplated that the windows 54 could extend further along the exhaust side of the piston 24 should the engine 10 not be provided with the auxiliary exhaust ports 60. Projections of the windows 54 onto the lateral plane 76 generally have the shape of rectangles with rounded corners. However, the sides of the windows 54 disposed on the exhaust side of the piston 24 each have an arcuate recess 86 to permit the insertion and removal of the piston pin 48 in the pin bores 44. Projections of the arcuate recesses 86 onto the lateral plane 76 have generally the same radius of curvature as the pin bores 44 and have the pin bore axis 52 as a center of curvature. It is contemplated that the windows 54 may have other shapes. It is also contemplated that more windows could be provided. As best seen in FIG. 11, the inner side of the skirt 68 has a thickened portion 87 around each window 54 to reinforce the skirt 68 in this area.

Figure 7:
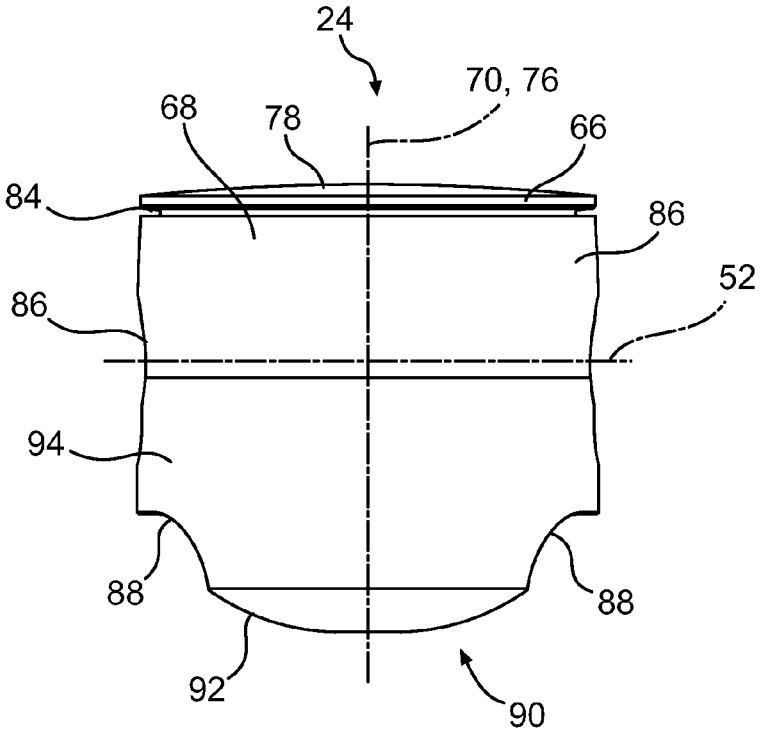
FIG. 7 is a side elevation view of the piston of FIG. 3 taken from an exhaust side thereof.

As best seen in FIGS. 8 and 9, the skirt 68 also defines two arches 88 at a free end 90 thereof (i.e. the end not connected to the crown 66). The arches 88 are disposed on opposite sides of the lateral plane 76 and are arranged symmetrically with respect to the lateral plane 76. The arches 88 have flat tops, but could have other shapes. As can be seen in FIGS. 5 and 7, the portions 92 of the free end 90 of the skirt 68 disposed between the arches 88 have a generally arcuate profile. It is contemplated that the profiles of the portions 92 of the skirt 68 may have other shapes. The arches 88 extend longer on the intake side than on the exhaust side of the piston 24, as a result the portion 92 on the intake side of the piston 24 is narrower than the portion 92 on the exhaust side of the piston 24.

The windows 54 and the arches 88 help reduce the weight of the piston 24, but it is contemplated that they could be omitted.

The skirt 68 has a skirt outer side 94 and a skirt inner side 96. An inwardly projecting ring 98 is connected to the skirt inner side 96. The ring 98 is disposed between the windows 54 and the arches 88 in the direction defined by the reciprocation axis 70. The pin bosses 42 are disposed between the ring 98 and the crown 66 in the direction defined by the reciprocation axis 70. Crescent shaped walls 99 are connected to the ring 98 on both sides of the lateral plane 76. The ring 98 and walls 99 provide additional strength to the skirt 68 and also provide elements that can be used to attach the piston 24 to machine features of the piston 24. It is contemplated that the walls 99 and/or the ring 98 could be omitted.

The piston 24 also has a pair of pin boss assemblies 100. Each pin boss assembly 100 includes one of the above-mentioned pin bosses 42, its associated pin bore 44, and other elements described in greater detail below. The pin boss assemblies 100 are disposed on opposite sides of the lateral plane 76 and are spaced apart in the direction defined by the pin bore axis 52. The pin boss assemblies 100 are connected to the crown inner side 80 and the skirt inner side 96 as will be described below.

The crown 66, the skirt 68, the ring 98 and the pin boss assemblies 100 are integrally formed by a metal casting process. In one embodiment, the piston 24 is made by investment casting, also known as lost wax casting. It is contemplated that other casting processes could be used. The piston 24 is made of high grade steel. In one embodiment, the steel used is a high-tensile strength, quenched and tempered alloyed steel, such as, for example, 42CrMo4 high grade steel having a tensile strength of about 1100 $N/mm^2$. Depending on the operating conditions of the piston 24, it is contemplated that other types of steel could be used.

Turning now to FIGS. 10 and 11, the pin boss assemblies 100 will be described in more detail. As the pin boss assemblies 100 are mirror images of each other about the lateral plane 76, only one of the piston boss assemblies 100 will be described for simplicity. The corresponding features of the other pin boss assembly 100 are numbered with the same reference numerals in the figures.

In addition to the pin boss 42, the pin boss assembly 100 has a rib 102, a central strut 104, an intake side strut 106 and an exhaust side strut 108. The rib 102 is connected to the crown inner side 80 and extends toward the pin boss 42. The rib 102 extends from the skirt inner side 96 on the intake side of the piston 24 to the skirt inner side of the piston 24 on the exhaust side of the piston 24 in a direction generally parallel to the lateral axis 72. As can be seen in FIG. 11, the rib 102 becomes narrower in the direction defined by the reciprocation axis 70 as it extends away from its center and then becomes thicker and wider before connecting to the skirt inner side 96. The pin boss 42 and the rib 102 are generally aligned with each other in the direction defined by the pin bore axis 52.

The central strut 104 extends between the pin boss 42 and the crown inner side 80 in the direction defined by the reciprocation axis 70, thereby connecting the pin boss to the crown inner side 80. The central strut 104 is centered relative to the pin boss axis 52. The central strut 104 is also connected to the rib 102. The dimension D1 of the central portion of the central strut 104 in the direction defined by the lateral axis 72 is less than 40 percent of the diameter of the pin bore 44.

The intake side strut 106 has one end connected to a side of the pin boss 42 and extends diagonally therefrom such that its other end is connected to a junction of the crown inner side 80 and the skirt inner side 96 on the intake side of the piston 24. The intake side strut 106 is generally parallel to the plane 76. The dimension D2 (FIG. 10) of the central portion of the intake side strut 106 in the direction defined by the pin bore axis 52 is at least twice the dimension D3 (FIG. 11) of the central portion of the intake side strut 106 in a direction that is perpendicular to the pin bore axis 52 and to a central longitudinal axis 110 of the intake side strut 106.

The exhaust side strut 108 is disposed on the side of the plane 74 opposite the one where the intake side strut 106 is located. The exhaust side strut 108 has one end connected to a side of the pin boss 42 and extends diagonally therefrom such that its other end is connected to a junction of the crown inner side 80 and the skirt inner side 96 on the exhaust side of the piston 24. The exhaust side strut 108 is generally parallel to the plane 76. The dimension D4 (FIG. 10) of the central portion of the exhaust side strut 108 in the direction defined by the pin bore axis 52 is at least twice the dimension D5 (FIG. 11) of the central portion of the exhaust side strut 108 in a direction that is perpendicular to the pin bore axis 52 and to a central longitudinal axis 112 of the exhaust side strut 108. As can be seen in FIG. 10, the dimension D6 of the outer end of the exhaust side strut 108 in the direction defined by the pin bore axis 52 is greater than the dimension D7 of the inner end of the exhaust side strut 108 in the same direction. In one embodiment, the dimension D6 is at least 20 percent greater than the dimension D7.

Two ribs 114 are connected to the crown inner side 80 and extend toward the pin boss 42. The ribs 114 are disposed on both sides of the plane 74 and extend from one rib 102 to the other rib 102. Two other ribs 116 are connected to the crown inner side 80 and extend toward the pin boss 42. The plane 74 passes through the ribs 116. Each rib 116 extends from one of the ribs 102 to the skirt inner side 96.

Figure 12:
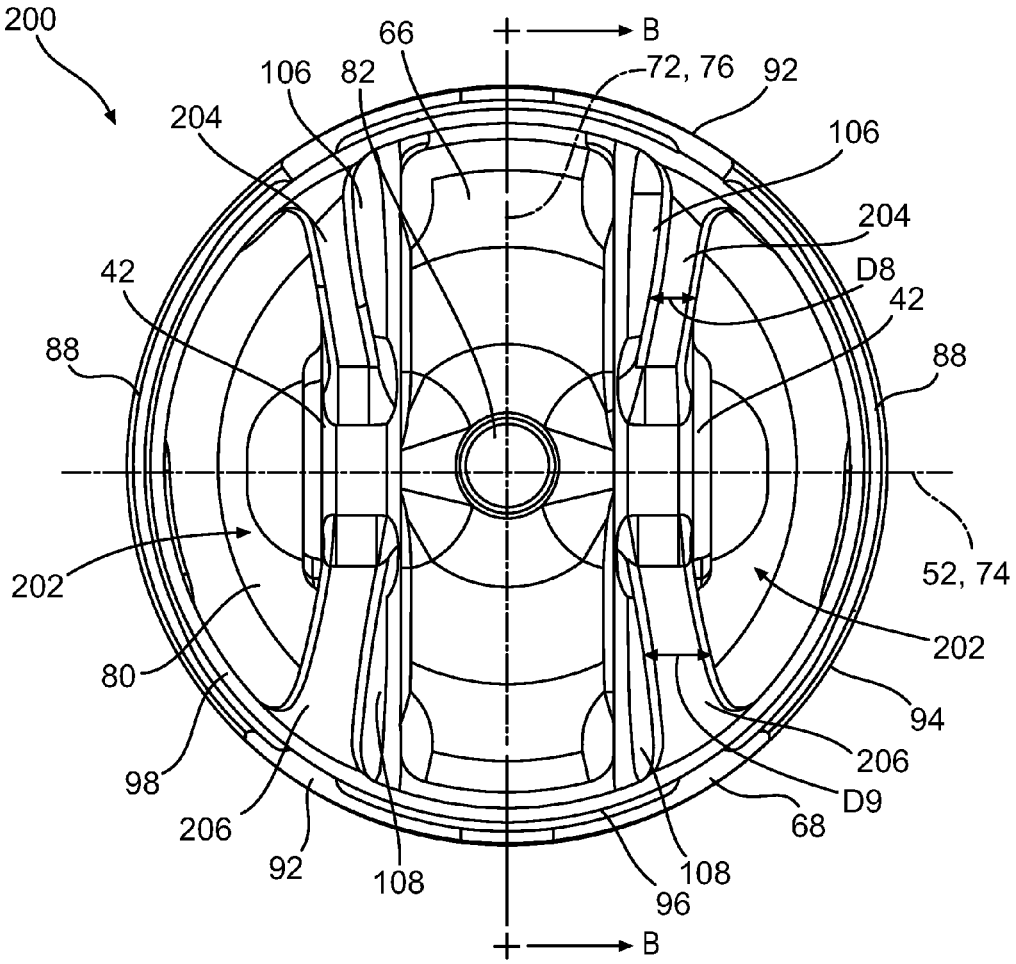
FIG. 12 is a bottom plan view of an alternative embodiment of the piston of FIG. 3.
Figure 13:
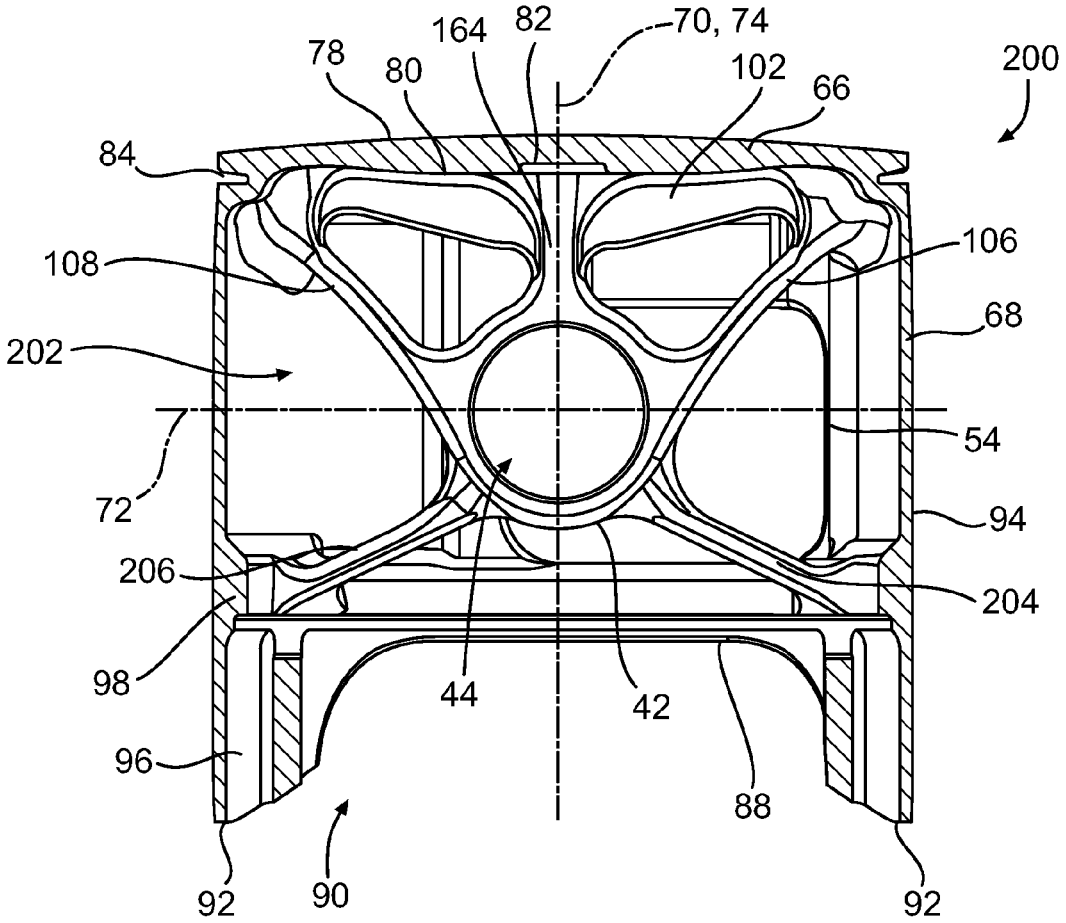
FIG. 13 a cross-sectional view of the piston of FIG. 12 taken along line B-B of FIG. 12.

Turning now to FIGS. 12 and 13, a piston 200, which is an alternative embodiment of the piston 24, will be described. The piston 200 is the same as the piston 24 except that the pin boss assemblies 100 have been replaced with pin boss assemblies 202 and that the thickened portions 87, the walls 99 and ribs 114, 116 have been omitted. It is however contemplated that one or more of the thickened portions 87, the walls 99 and ribs 114, 116 could be provided. For simplicity, the elements of the piston 200 that are the same as those of the piston 24 will not be described again and have been numbered with the same reference numerals in the figures. As the pin boss assemblies 202 are mirror images of each other about the lateral plane 76, only one of the piston boss assemblies 202 will be described for simplicity. The corresponding features of the other pin boss assembly 202 are numbered with the same reference numerals in the figures.

The pin boss assembly 202 consists of all of the same elements as the boss assembly 100 described above with the addition of a lower intake side strut 204 and a lower exhaust side strut 206. The elements of the pin boss assembly 202 that are the same as those of the pin boss assembly 100 will not be described again.

The lower intake side strut 204 is disposed on the same side of the plane 74 as the intake side strut 106. The lower intake side strut 204 has one end connected to a side of the pin boss 42 and extends diagonally therefrom away from the crown 66 and the plane 76 such that its other end is connected to the ring 98 on the intake side of the piston 24. It is contemplated that the lower intake side strut 204 could alternatively be connected directly to the skirt inner side 96. The dimension D8 (FIG. 10) of the central portion of the lower intake side strut 204 in the direction defined by the pin bore axis 52 is between 50 and 70 percent of the dimension D2 of the intake side strut 106.

The lower exhaust side strut 206 is disposed on the same side of the plane 74 as the exhaust side strut 108. The lower exhaust side strut 206 has one end connected to a side of the pin boss 42 and extends diagonally therefrom away from the crown 66 and the plane 76 such that its other end is connected to the ring 98 on the exhaust side of the piston 24. It is contemplated that the lower exhaust side strut 206 could alternatively be connected directly to the skirt inner side 96. The dimension D9 (FIG. 10) of the central portion of the lower exhaust side strut 206 in the direction defined by the pin bore axis 52 is between 50 and 70 percent of the dimension D4 of the exhaust side strut 108.

Modifications and improvements to the above-described embodiments of the present invention may become apparent to those skilled in the art. The foregoing description is intended to be exemplary rather than limiting. The scope of the present invention is therefore intended to be limited solely by the scope of the appended claims.

What is claimed is:

1. A piston for an internal combustion engine comprising:
a crown having a crown outer side and a crown inner side;
a skirt extending from the crown, the skirt having a skirt outer side and a skirt inner side, the skirt defining a reciprocation axis of the piston;
first and second pin boss assemblies connected to the crown inner side and the skirt inner side, the first and second pin boss assemblies defining a pin bore axis perpendicular to the reciprocation axis, the first and second pin boss assemblies being adapted for receiving a piston pin having a piston pin axis with the piston pin axis being coaxial with the pin bore axis, the first and second piston boss assemblies being disposed on opposite sides of the reciprocation axis and being spaced apart in a direction defined by the pin bore axis,
each of the first and second pin boss assemblies comprising:
a pin boss defining a pin bore, the pin bore defining the pin bore axis;
a rib extending from the crown inner side toward the pin boss, at least a portion of the rib being aligned with the pin boss in the direction defined by the pin bore axis, the rib extending along the crown inner side along a direction generally parallel to a lateral axis of the piston, the lateral axis of the piston intersecting and being perpendicular to the reciprocation axis and the pin bore axis,
a central strut extending from the pin boss to the crown inner side in a direction generally parallel to the reciprocation axis, the central strut being generally centered relative to the pin bore axis;
a first diagonally extending strut having a first end connected to the pin boss and a second end connected to a junction of the crown inner side and the skirt inner side; and
a second diagonally extending strut having a first end connected to the pin boss and a second end connected to the junction of the crown inner side and the skirt inner side,
the first and second struts being disposed on opposite sides of a plane containing the reciprocation axis and the pin bore axis.

2. The piston of claim 1, wherein for each of the first and second pin boss assemblies:
the central strut is connected to the rib.

3. The piston of claim 1, wherein for each of the first and second pin boss assemblies:
a dimension of at least a portion of the central strut in a direction defined by the lateral axis is less than 40 percent of a diameter of the pin bore.

4. The piston of claim 1, wherein for each of the first and second pin boss assemblies:
a dimension of a portion of the first strut in the direction defined by the pin bore axis is at least twice a dimension of the portion of the first strut in a direction perpendicular to the pin bore axis and to a central longitudinal axis of the first strut; and
a dimension of a portion of the second strut in the direction defined by the pin bore axis is at least twice a dimension of the portion of the second strut in a direction perpendicular to the pin bore axis and to a central longitudinal axis of the second strut.

5. The piston of claim 1, wherein for each of the first and second pin boss assemblies:
a dimension of the second strut in the direction defined by the pin bore axis is at least 20 percent greater at the second end of the second strut than at the first end of the second strut.

6. The piston of claim 1, wherein each of the first and second pin boss assemblies further comprises:
a third diagonally extending strut having a first end connected to the pin boss and a second end connected to the skirt inner side, the second end of the third strut being further from the crown than the first end of the third strut, the third strut being disposed on a same side of the plane as the first strut; and
a fourth diagonally extending strut having a first end connected to the pin boss and a second end connected to the skirt inner side, the second end of the fourth strut being further from the crown than the first end of the fourth strut, the fourth strut being disposed on a same side of the plane as the second strut.

7. The piston of claim 6, wherein for each of the first and second pin boss assemblies:
a dimension of a portion of the third strut in the direction defined by the pin bore axis is between 50 and 70 percent of a dimension of a portion of the first strut in the direction defined by the pin bore axis; and
a dimension of a portion of the fourth strut in the direction defined by the pin bore axis is between 50 and 70 percent of a dimension of a portion of the second strut in the direction defined by the pin bore axis.

8. The piston of claim 6, wherein for each of the first and second pin boss assemblies:
the plane is a first plane;
the second end of the third strut is further from a second plane than the first end of the third strut;
the second plane contains the reciprocation axis and the lateral axis; and
the second end of the fourth strut is further from the second plane than the first end of the fourth strut.

9. The piston of claim 6, further comprising a ring connected to the skirt inner side;
wherein for each of the first and second pin boss assemblies:
the pin boss is disposed between the ring and the crown in a direction defined by the reciprocation axis; and
the second ends of the third and fourth struts are connected to the ring.

10. The piston of claim 1, further comprising a ring connected to the skirt inner side; and
wherein for each of the first and second pin boss assemblies the pin boss is disposed between the ring and the crown in a direction defined by the reciprocation axis.

11. The piston of claim 1, wherein:
the plane is a first plane;
a second plane contains the reciprocation axis and the lateral axis;
the skirt defines a first arch and a second arch at a free end thereof; and
the first and second arches are disposed on opposite sides of the second plane.

12. The piston of claim 1, wherein the crown defines a piston ring groove on an outer circumference thereof.

13. The piston of claim 1, wherein:
the plane is a first plane;
a second plane contains the reciprocation axis and the lateral axis;
the piston is asymmetrical about the first plane; and
the piston is symmetrical about the second plane.

14. The piston of claim 1, wherein the crown, the skirt and the first and second pin boss assemblies are made of steel.

15. The piston of claim 14, wherein the crown, the skirt and the first and second pin boss assemblies are integrally formed via a casting process.

16. An internal combustion engine comprising:

a cylinder;

a piston according to claim 1 disposed in the cylinder;

a piston pin received in the piston bores of the piston;

a connecting rod having a first end connected to the piston pin and a second end; and a crankshaft connected to the second end of the connecting rod.

17. The engine of claim 16, wherein the engine is a direct fuel injection two-stroke engine.

18. The piston of claim 1, wherein:

the plane is a first plane;

a second plane contains the reciprocation axis and the lateral axis; and for each of the first and second pin boss assemblies at least a portion of the pin boss and at least a portion of the rib are at a same distance from the second plane.

* * * * *